US006186220B1

(12) United States Patent
Sucker et al.

(10) Patent No.: US 6,186,220 B1
(45) Date of Patent: Feb. 13, 2001

(54) FUNNEL GEOMETRY OF A MOLD FOR THE CONTINUOUS CASTING OF METAL

(75) Inventors: Jürgen Sucker, Düsseldorf; Holger Beyer-Steinhauer, Mettmann, both of (DE)

(73) Assignees: SMS Schloemann-Siemag Aktiengesellschaft, Düsseldorf (DE); Acciai Speciali Terni S.p.A., Terni (IT)

( * ) Notice: Under 35 U.S.C. 154(b), the term of this patent shall be extended for 0 days.

(21) Appl. No.: 09/154,908

(22) Filed: Sep. 17, 1998

(30) Foreign Application Priority Data

Sep. 27, 1997 (DE) ..... 197 42 795

(51) Int. Cl.[7] ..... B22D 11/00
(52) U.S. Cl. ..... 164/459; 164/418
(58) Field of Search ..... 164/459, 418

(56) References Cited

U.S. PATENT DOCUMENTS 4,249,590 * 2/1981 Willim ..... 164/418
4,926,930 * 5/1990 Gay et al. ..... 164/418
5,927,378 * 7/1999 Grove et al. ..... 164/485
5,941,298 * 8/1999 Pleschiutschnigg ..... 164/418

FOREIGN PATENT DOCUMENTS 3907351 9/1990 (DE) .
0268910 9/1991 (EP) .
0552501 7/1993 (EP) .
2-207945 * 8/1990 (JP) ..... 164/418

* cited by examiner

*Primary Examiner*—Harold Pyon
*Assistant Examiner*—I.-H. Lin
(74) *Attorney, Agent, or Firm*—Friedrich Kueffner

(57) ABSTRACT

A mold for the continuous casting of metal includes a pouring portion with cooled long side walls and short side walls, wherein the pouring portion becomes narrower in the shape of a funnel in the casting direction until it reaches the size of the cast strand. In the funnel portion, the inner contours of the long side walls have in the casting direction from the top toward the bottom at least two points which have the property that they determine a straight line along which the inner contours of the long side walls are formed with at least one concave section and with at least one convex section in any selected sequence.

16 Claims, 5 Drawing Sheets

FUNNEL GEOMETRY OF A MOLD FOR THE CONTINUOUS CASTING OF METAL

BACKGROUND OF THE INVENTION

1. Field of the Invention

The present invention relates to a mold for the continuous casting of metal. The mold has a pouring portion with cooled long side walls and short side walls, wherein the pouring portion becomes narrower in the shape of a funnel in the casting direction until it reaches the size of the cast strand.

2. Description of the Related Art

The dimensions of the pouring portion are essentially determined by the cross-section of the strand to be cast, the dimensions of the pouring pipe and the depth of immersion of the pouring pipe in the molten metal.

Because of the funnel-shaped configuration of the long side walls, the mold not only narrows in the casting direction, but also a change of the shape of the strand cross-section takes place. Consequently, in contrast to a conventional continuous casting mold with planar walls, additional deformations are imparted on the strand shell when it travels through a funnel-type mold. In order to avoid the generation of surface defects of the cast product, these additional deformations may not exceed a certain boundary value, so that the strand shell is not overloaded and a uniform heat discharge over the cross-section of the strand remains ensured.

EP 0 268 910 B1 proposes to guide the strand shell which is still thin underneath the meniscus without deformation by providing long side walls which in the pouring portion extend essentially parallel to each other in a first section and are reduced to the thickness of the casting size in a subsequent section, wherein the first section extends to below the meniscus level to be adjusted during the casting operation into the area of the first strand shell formation. The entire change of shape to be imparted on the strand by the mold, which is required for reducing the strand to the thickness of the casting size, extends along the subsequent section which is formed by inclined or curved surfaces or combinations thereof.

EP 0 552 501 A2 discloses a mold for the continuous casting of steel strip in which the long side walls form a funnel-shaped pouring portion which is reduced toward the short side walls and in the casting direction to the size of the cast strip. The curvature of the funnel-shaped pouring portion is determined by lateral circular arcs and middle circular arcs connected to the lateral circular arcs at the tangential points. For reducing the friction and wear and for reducing the tensile stress and bending stress of the strand shell, the radii of the lateral circular arcs are uniform in a section which extends at least 100 mm down from the upper edge of the mold.

DE 39 07 351 A1 discloses a proposal for constructing the pouring funnel of a mold in such a way that the deformation of the metal cast strand is distributed over a travel length which is as long as possible and to avoid constrictions and the formation of cracks in the strand shell of the metal cast strand. This is achieved by forming the contour of the inner wall of the pouring funnel in the strand travel direction by three circular arcs which contact each other tangentially, wherein the radii of the circular arcs gradually increase in the strand travel direction and lead into the contour of the inner wall of the mold. A distribution of the change of the shape of the strand shell which is as uniform as possible in a pouring portion shaped in this manner is achieved thereby that the radii of the circular arcs increase in the strand travel direction with equal or unequal factors.

SUMMARY OF THE INVENTION

Therefore, it is the primary object of the present invention to provide a further funnel geometry of a mold which improves the reduction of friction and wear between the strand shell and the mold walls. Particularly in the case of a strand shell formation of a steel which has the tendency to be subject to relatively high shrinkage, an even more pronounced reduction of the defects formed at the slab surface is to be realized as a result of an adjustment of the shape change which is as uniform as possible.

The present invention is based on the finding that in the pouring portion the length change of the mold contour resulting from the transition from one level to a lower level has at each level a maximum and that corresponding to this maximum is an above-average local deformation or increased tendency to the formation of local gaps between strand and mold wall. Consequently, the pouring portion has at least one maximum of the length change of the horizontal mold contour and a distribution of the shape change over the pouring portion, which is as uniform as possible, can be achieved thereby that this maximum is as small as possible.

In accordance with the present invention, in the funnel portion, the inner contours of the long side walls have in the casting direction from the top toward the bottom at least two points which have the property that they determine a straight line along which the inner contours of the long side walls are formed with at least one concave section and with at least one convex section in any selected sequence.

The present invention also proposes that in the funnel portion the inner contours of the long side walls are formed at least along a partial length of a straight line drawn from the upper edge of the mold to the lower edge of the mold in the casting direction from the top toward the bottom with at least one concave section and with at least one convex section in any chosen sequence.

The object described above is also met in accordance with the present invention in that in the funnel portion the inner contours of the long side walls are formed along a straight line connecting the upper edge of the mold and the beginning of the lower section of the long side walls in the casting direction from the top toward the bottom with at least one concave section and with at least one convex section in any chosen sequence.

In accordance with an advantageous feature, concave sections and convex sections of the long side walls can lead directly into each other.

In accordance with another advantageous feature, in the casting direction from the top toward the bottom, the concave section is arranged first and then the convex section extending to the mold outlet.

In accordance with a further advantageous feature, each of the concave sections or the convex sections of the long side walls may have a uniform curvature over the length thereof as well as a changing curvature.

In accordance with a further development of the present invention, the inner contours of the long side walls have over the concave sections or over the convex sections thereof a circular arc-shaped configuration or a trigonometric configuration, for example, a sinusoidal configuration.

When the lower section of the mold has a portion with parallel walls, a particularly friction-free transition between the funnel portion and the subsequent portion with parallel walls is achieved thereby that the lower convex or concave section leads with a lower circular arc at the end into the straight portion having a steady configuration.

In accordance with another important further development of the funnel geometry according to the present invention, the curvatures of the individual sections of the long side walls are provided with such radii that the greatest local length change $delta_{max}$ (%/m) at the transition from one level to a lower level does not exceed four times the value of the mean local length changes over the funnel portion without taking into consideration sections with parallel walls; in particular, the greatest local length change should not exceed a value of 2.0%/m.

Finally, the mold according to the present invention is particularly intended to be used for the continuous casting of peritectic carbon steels and austenitic stainless steels which have the tendency to be subject to extremely high shrinkage.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
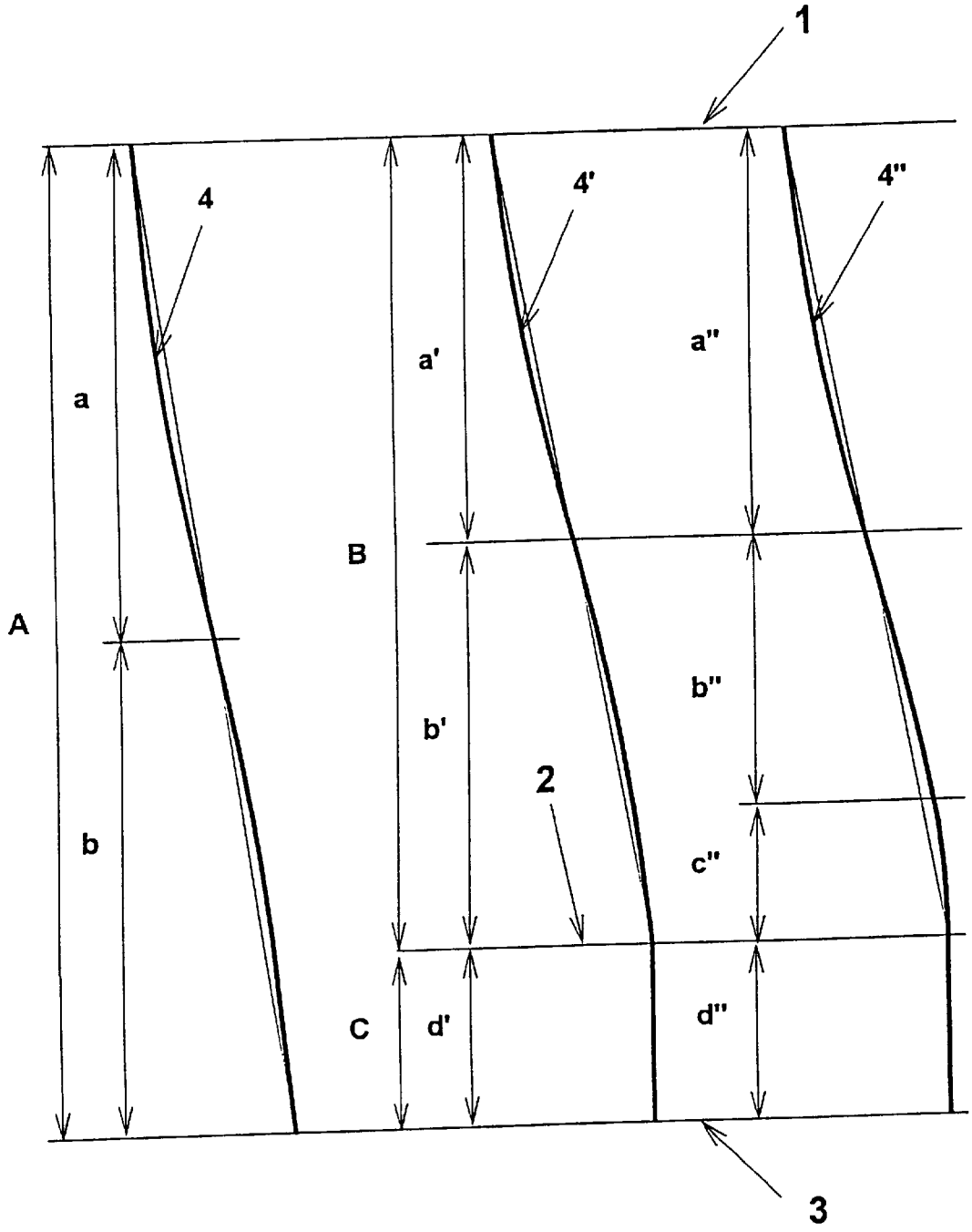
FIG. 1 is a sectional view along the middle axis of three different funnel-shaped inner contours of the long side walls of a mold according to the present invention.

The three different funnel contours of the long side wall of a mold shown in FIG. 1 have a pouring portion A which becomes narrower in the shape of a funnel in the casting direction until it reaches the size of the cast strand or a pouring portion B which becomes narrower in the shape of a funnel in the casting direction until it reaches the size of the cast strand, and a subsequent essentially parallel portion C. This mold portion or the mold outlet does not have to have parallel outlet surfaces or outlet edges. The lower mold portion or the lower mold outlet may have in the middle area thereof a small curvature of 1 to 15 mm for each long side wall.

In the funnel portion A, the funnel contours of the long side walls 4 are formed along a straight line connecting the upper edge 1 of the mold and the lower edge 3 of the mold from the top toward the bottom first with a concave section a and a subsequent convex section b. It is apparent that the inner contour 4 of the long side walls has over the sections a and b a sinusoidal configuration.

In the funnel portion B, the funnel contours of the long side walls 4' or 4" are formed along a straight line connecting the upper edge 1 of the mold and the beginning of the portion 2 with parallel walls from the top toward the bottom first with a concave section a' or a" and subsequently with a convex section b' or b" and c".

In this example, the inner contours 4' or 4" of the long side walls also have over the sections a' and b' or a" and b" a sinusoidal configuration.

FIG. 1 additionally shows that the convex section b" with a circular arc c" at the lower end leads into the parallel portion d" having a steady configuration.

In accordance with another important feature of the funnel geometry according to the present invention, each of the concave sections a, a' and a" or of the convex sections b, b' and b" may have a uniform curvature or a changing curvature.

In the funnel geometry which has been evaluated, the curvatures of the sections a, b, a', b', a", b", c" are provided with such radii that the greatest local length change at the transition from one level to a lower level ($delta_{max}$) does not exceed a value of 2.0%/m and simultaneously does not exceed four times the value of the mean local length changes over the funnel portion without taking into consideration the parallel sections d' and d".

Figure 2A:
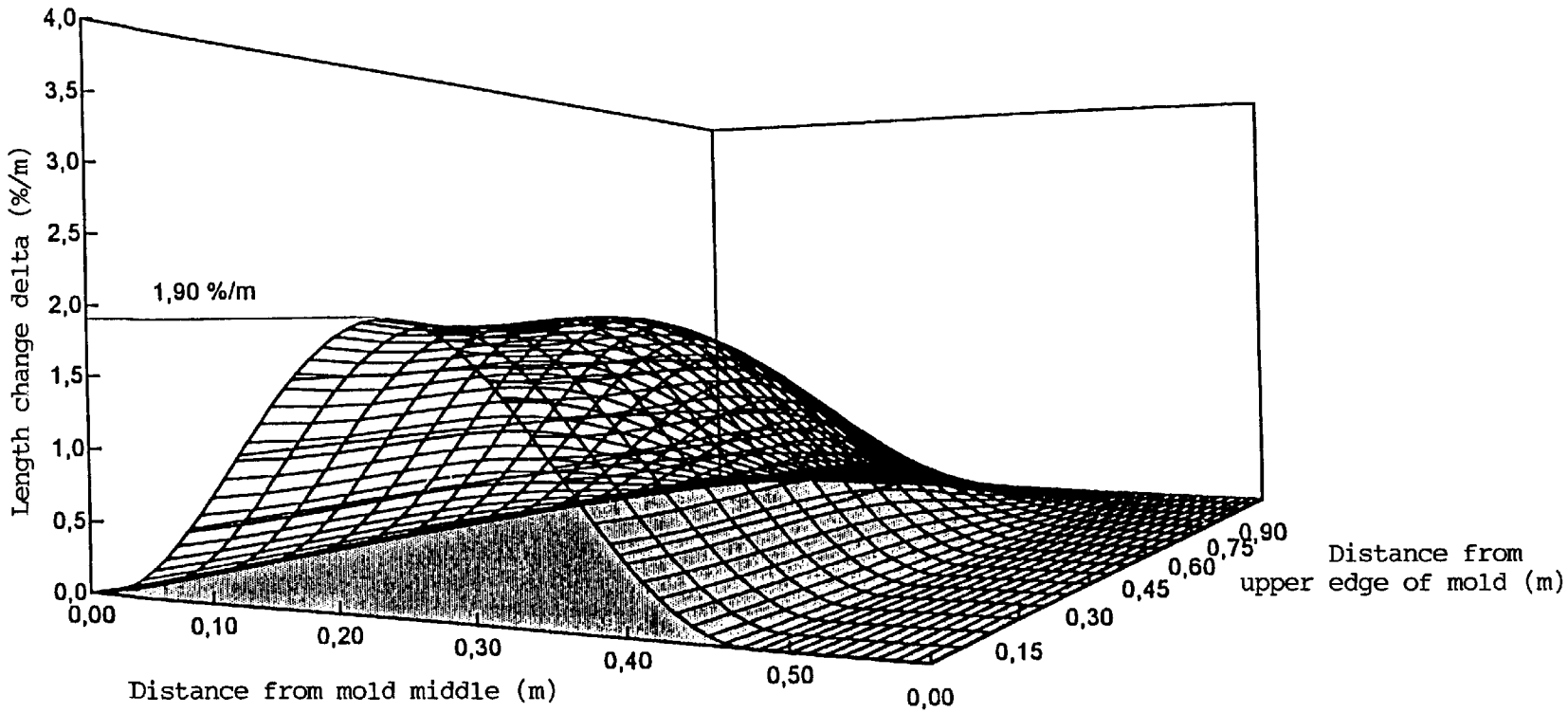
FIG. 2*a* is a three-dimensional diagram showing length changes of the inner contour in the pouring portion at different distances from the upper edge of the mold as well as from the mold middle.
Figure 2B:
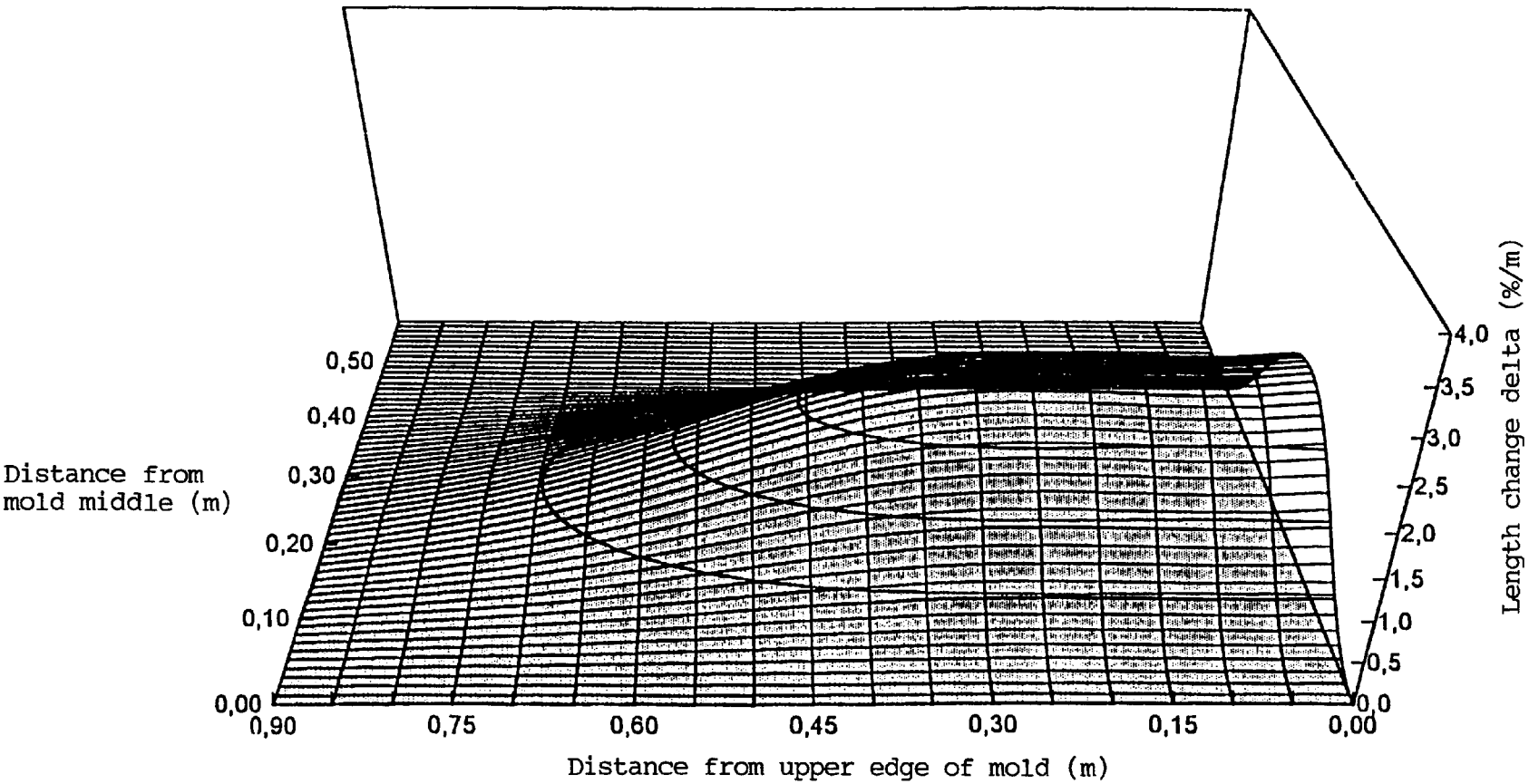
FIG. 2*b* is another three-dimensional diagram showing the length change also in dependence on the distances from the upper edge of the mold as well as from the mold middle.

FIGS. 2*a* and 2*b* are three-dimensional diagrams showing the distribution of the shape change in the funnel portion of the long side wall of a mold with the following parameters:

Funnel width 950 mm;

Funnel depth at the upper edge of the mold plate 45 mm;

Funnel length 900 mm;

Sinusoidal horizontal contour.

In a sinusoidally constructed vertical contour 4' of the pouring portion according to FIG. 1 with an amplitude of 1.52 mm, the maximum local change is 1.90%/m and the main length change over the sections a' and b' and the funnel width is 0.50%/m.

Figure 3A:
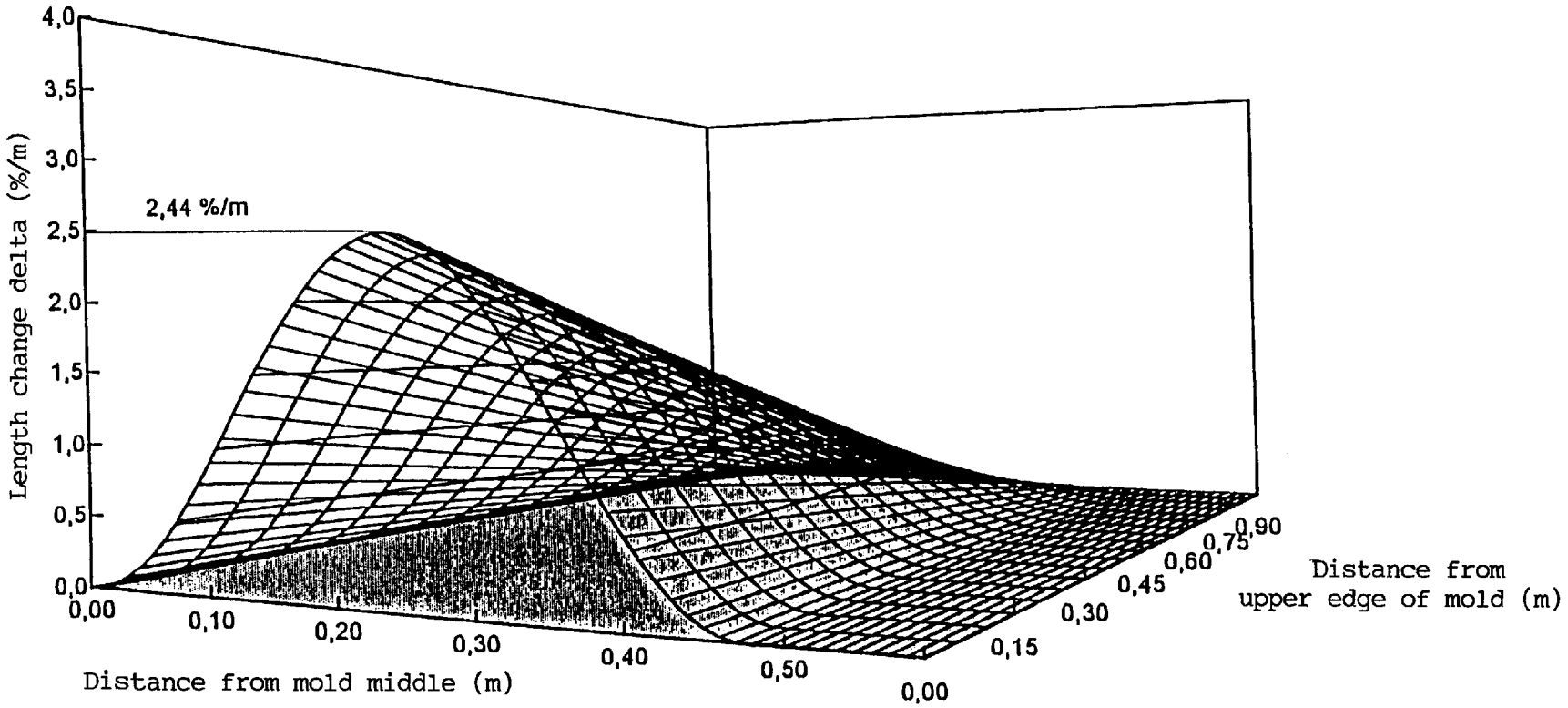
FIG. 3*a* is a three-dimensional diagram showing length changes of the inner contour in the pouring portion of a conventional mold, also at a distance from the upper edge of the mold as well as from the mold middle.
Figure 3B:
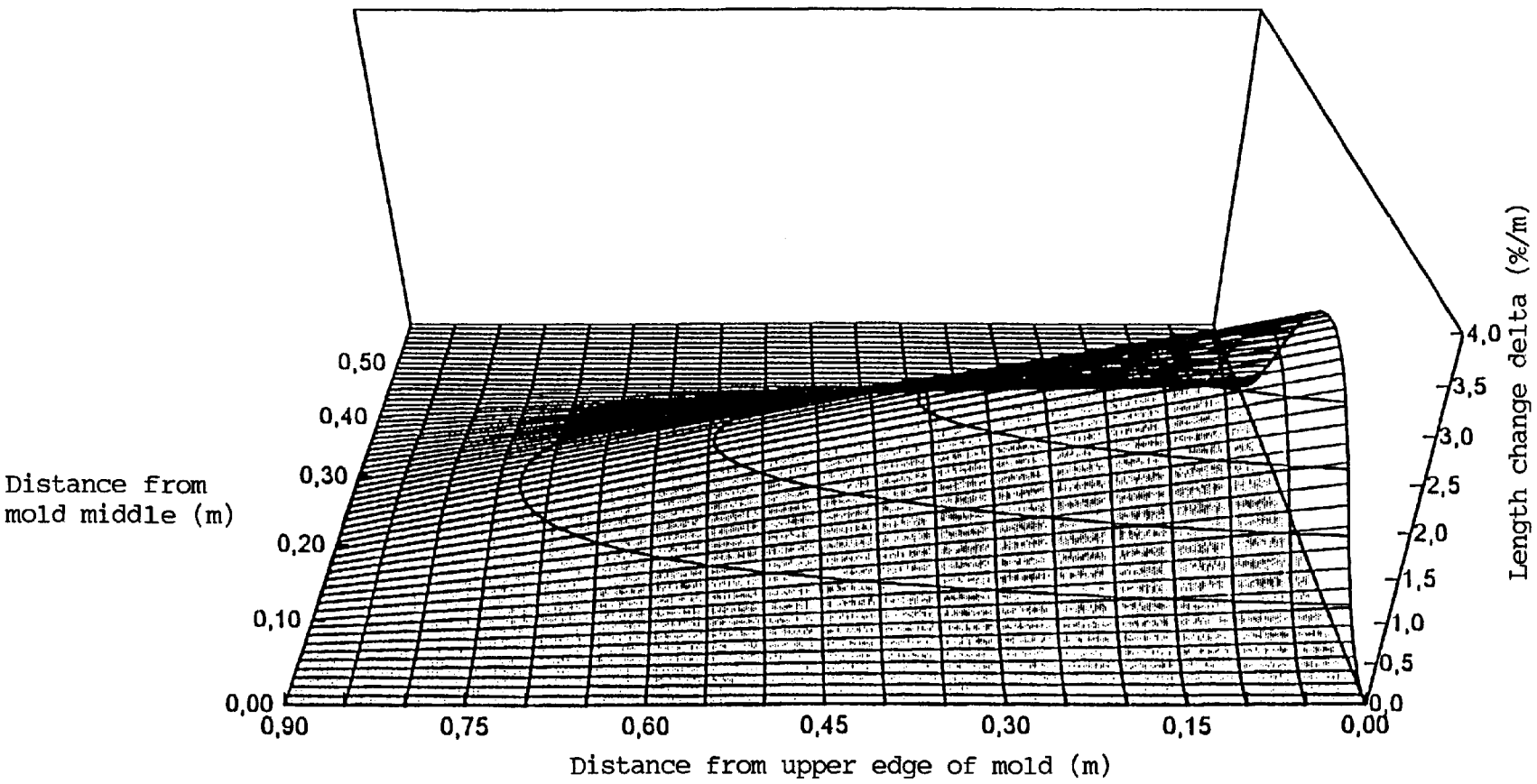
FIG. 3*b* is a three-dimensional diagram showing length changes of the inner contour in the pouring portion of a conventional mold in dependence on the distance from the upper edge of the mold as well as from the mold middle.

FIGS. 3*a* and 3*b* are three-dimensional diagrams corresponding to FIGS. 2*a* and 2*b* for a mold of conventional construction in which the vertical mold contour of the long side is formed by a straight line. In this case, the maximum local length change is significantly greater at 2.44%/m. It can also be seen that the distribution of the shape change is substantially less uniform and is particularly great in the area of the upper edge of the mold where the strand shell formation is most sensitive. It is especially these disadvantages which are avoided by the present invention.

While specific embodiments of the invention have been shown and described in detail to illustrate the inventive principles, it will be understood that the invention may be embodied otherwise without departing from such principles.

We claim:

1. A mold for the continuous casting of metal comprising cooled long side walls and short side walls forming a pouring portion which narrows in the shape of a funnel in a casting direction toward a size of a cast strand, wherein the long side walls have inner contours, and wherein in the funnel-shaped pouring portion the inner contours of each long side wall have in the casting direction from the top toward the bottom at least two points having the property that they determine a straight line along which the inner contours are formed with at least one concave section and with at least one convex section in any sequence.

2. The mold according to claim 1, wherein in the funnel-shaped portion the inner contours of the long side walls are formed at least along a partial length of a straight line drawn from an upper edge of the mold to a lower edge of the mold in the casting direction from the top toward the bottom with at least one concave section and one convex section in any sequence.

3. The mold according to claim 1, wherein in the funnel-shaped portion the inner contours of the long side walls are formed along a straight line connecting an upper edge of the mold and a beginning of a lower vertical section in the casting direction from the top toward the bottom with at least one concave section and with at least one convex section in any sequence.

4. The mold according to claim 1, wherein the concave sections and the convex sections are connected directly to each other.

5. The mold according to claim 1, further comprising an intermediate contour between the concave sections and the convex sections.

6. The mold according to claim 1, wherein in the funnel-shaped portion the inner contours of the long side walls are formed from the top toward the bottom first with a concave section and subsequently with a convex section.

7. The mold according to claim 1, wherein the inner contours of the long side walls do not extend parallel to each other.

8. The mold according to claim 1, wherein the inner contours of the long side walls are circular arc-shaped over at least a partial section.

9. The mold according to claim 1, wherein the inner contours of the long side walls are trigonometrically-shaped over at least a partial section.

10. The mold according to claim 9, wherein the inner contours of the long side walls have a sinusoidal shape.

11. The mold according to claim 1, wherein a lower section of the long side walls has a circular-arc shape at a lower end thereof connected to a lower section having a steady configuration.

12. The mold according to claim 11, wherein the lower steady section has parallel walls.

13. The mold according to claim 1, wherein each of the concave sections and the convex sections has a uniform curvature as well as a changing curvature.

14. The mold according to claim 1, wherein, for achieving a uniform distribution of the shape change over the pouring portion, a maximum shape change in all levels of an upper mold half is equal or essentially equal.

15. The mold according to claim 1, wherein the concave and convex sections have curvatures with radii selected such that a greatest length change at a transition from a level to a lower level does not exceed four times a value of a mean local length change over the funnel-shaped portion without taking into consideration sections with parallel walls.

16. The mold according to claim 15, wherein the greatest local length change does not exceed a value of 2.0%/m.

* * * * *